US006520786B2

(12) United States Patent
Nakamura et al.

(10) Patent No.: US 6,520,786 B2
(45) Date of Patent: Feb. 18, 2003

(54) CONNECTOR

(75) Inventors: Hideto Nakamura, Yokkaichi (JP); Kei Yanagisawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/053,038

(22) Filed: Jan. 18, 2002

(65) Prior Publication Data

US 2002/0115322 A1 Aug. 22, 2002

(30) Foreign Application Priority Data

Jul. 25, 2001 (JP) ..... 2001-224824

(51) Int. Cl.[7] ..... H01K 29/00
(52) U.S. Cl. ..... 439/188
(58) Field of Search ..... 439/188, 489; 200/51.1

(56) References Cited

U.S. PATENT DOCUMENTS 4,850,888 A * 7/1989 Denlinger et al. ..... 439/188
5,647,754 A 7/1997 Kohno ..... 439/188
5,791,922 A * 8/1998 Takata et al. ..... 439/188
5,944,547 A * 8/1999 Golab et al. ..... 439/188
6,036,515 A * 3/2000 Nakamura ..... 439/188

FOREIGN PATENT DOCUMENTS

| | | | |
|---|---|---|---|
| DE | 295 09 310 | 9/1995 | |
| EP | 1 091 455 | 4/2001 | |
| JP | 11-67363 | * 3/1999 | ..... H01R/13/64 |
| JP | 11-176522 | 7/1999 | |

* cited by examiner

*Primary Examiner*—P. Austin Bradley
*Assistant Examiner*—Ross Gushi
(74) *Attorney, Agent, or Firm*—Anthony J. Casella; Gerald E. Hespos

(57) ABSTRACT

A connector includes first and second housings (10, 30). During connection of the housings (10, 20), a slanted surface (38) of a pushing portion (37) comes into contact with receiving pieces (20) of a shorting terminal (15), which in turn is deformed resiliently by the inclination of the pushing portion (37) and moves away from male terminal fittings (13) to cancel a shorted state of the male terminal fittings (13). The pushing portions (37) are hard to deform and are provided with slanted surface (38) for resiliently deforming the shorting terminal (15). Therefore, the pushing portions (37) can deform the shorting terminal (15) without losing its guiding function even if the pushing portion (37) and the shorting terminal (15) get caught with each other at their contact portions.

8 Claims, 4 Drawing Sheets

CONNECTOR

BACKGROUND OF THE INVENTION

1. Field of the Invention

The invention relates to a connector with a shorting terminal.

2. Description of the Related Art

A connector with a shorting terminal is disclosed in Japanese Unexamined Patent Publication No. 11-176522. This known connector has mateable male and female connector housings. A plurality of female terminal fittings and a shorting terminal are provided in the female housing. The shorting terminal is formed with terminal contacts that establish a shorting contact with the female terminal fittings when the housings are not mated. The terminal contacts of the shorting terminal are configured to contact the female terminal fittings in a direction substantially normal to a connecting direction of the housings. Receiving pieces are located immediately forward of the terminal contacts and project in a direction oblique to the connecting direction of the housings. A pushing portion projects forward from the front end of the male housing and contacts the receiving pieces during connection of the housings to incline the receiving pieces and to deform the shorting terminal resiliently in a direction substantially normal to the connecting direction of the housings. Thus, the terminal contacts are disengaged from the female terminal fittings as the shorting terminal is deformed, and the shorted state of the female terminal fittings is cancelled.

The receiving pieces of the above-described connector may be deformed inadvertently and may lose their guiding function if the forwardly-projecting pushing portion and the receiving pieces get caught with each other. Thus, the shorting terminal will not be deformed resiliently in the direction normal to the connecting direction of the housings. Accordingly, there is a possibility that the shorted state of the female terminal fittings may not be cancelled and the shorting terminal may be rendered unusable.

In view of the above situation, an object of the present invention is to provide a connector that securely resiliently deforms a shorting terminal.

SUMMARY OF THE INVENTION

The invention is directed to a connector with first and second connector housings that are connectable with each other. Terminal fittings and a shorting terminal are provided in the first connector housing. The shorting terminal normally is held in shorting contact with the terminal fittings. A pushing portion is provided in the second connector housing and has a slanted surface aligned oblique to the connecting direction of the connector housings. The pushing portion deforms the shorting terminal resiliently or elastically away from the terminal fittings by contacting the shorting terminal during connection of the connector housings.

The slanted surface of the pushing portion is difficult to deform. Accordingly, the pushing portion can deform the shorting terminal without losing a guiding function of the slanted surface even if the pushing portion and the shorting terminal get caught with each other at their contact portions.

The second connector housing preferably is formed with a pressing surface that is substantially continuous with the pushing portion and substantially parallel with the connecting direction of the connector housings. The shorting terminal is held in contact with the pressing surface when the connector housings are connected with each other to restrict displacement of the shorting terminal toward the terminal fittings.

The alignment of the pressing surface parallel to the connecting direction of the housings restricts the approach of the shorting terminal toward the terminal fittings, and hence the shorting terminal is held in contact with the pressing surface. Thus, the degree of resilient deformation of the shorting terminal becomes constant even if the depth of connection of the housings varies. Consequently, the spacing between the shorting terminal and the terminal fittings becomes constant. In contrast, the degree of resilient deformation of the shorting terminal would vary with depth of connection of the housings if the shorting terminal was brought the into contact with a surface oblique to the connecting direction of the housings. In that situation, the space between the shorting terminal and the terminal fittings cannot be constant.

Receiving pieces preferably are formed at the leading end of the shorting terminal. The receiving pieces are oblique to the connecting direction of the connector housings and can come into sliding contact with the slanted surface of the pushing portion during connection of the connector housings. The slanted surface of the pushing portion and the obliquely aligned receiving pieces of the shorting terminal slide smoothly over each other without getting caught. Therefore, the shorting terminal can undergo a smooth resilient deformation.

The receiving pieces preferably have substantially the same inclination as the slanted surface before the shorting terminal contacts the pushing portion.

The shorting terminal may comprise a plurality of resilient contact pieces folded back from a main section to extend towards the terminal fittings.

The resilient contact pieces each may comprise an angled terminal contact portion, an extending portion that extends forward from the front end of the terminal contact portion and/or a receiving piece that extends oblique to the connecting direction of the housings from the front end of the extending portion.

The first connector housing preferably comprises a receptacle in which the second connector housing is insertable. A portion of the receptacle and the pushing portion define a space into which the shorting terminal is insertable when the connector housings are connected with each other.

The pushing portion preferably is provided on the second connector housing by means of a recess on an outer surface of the second connector housing.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
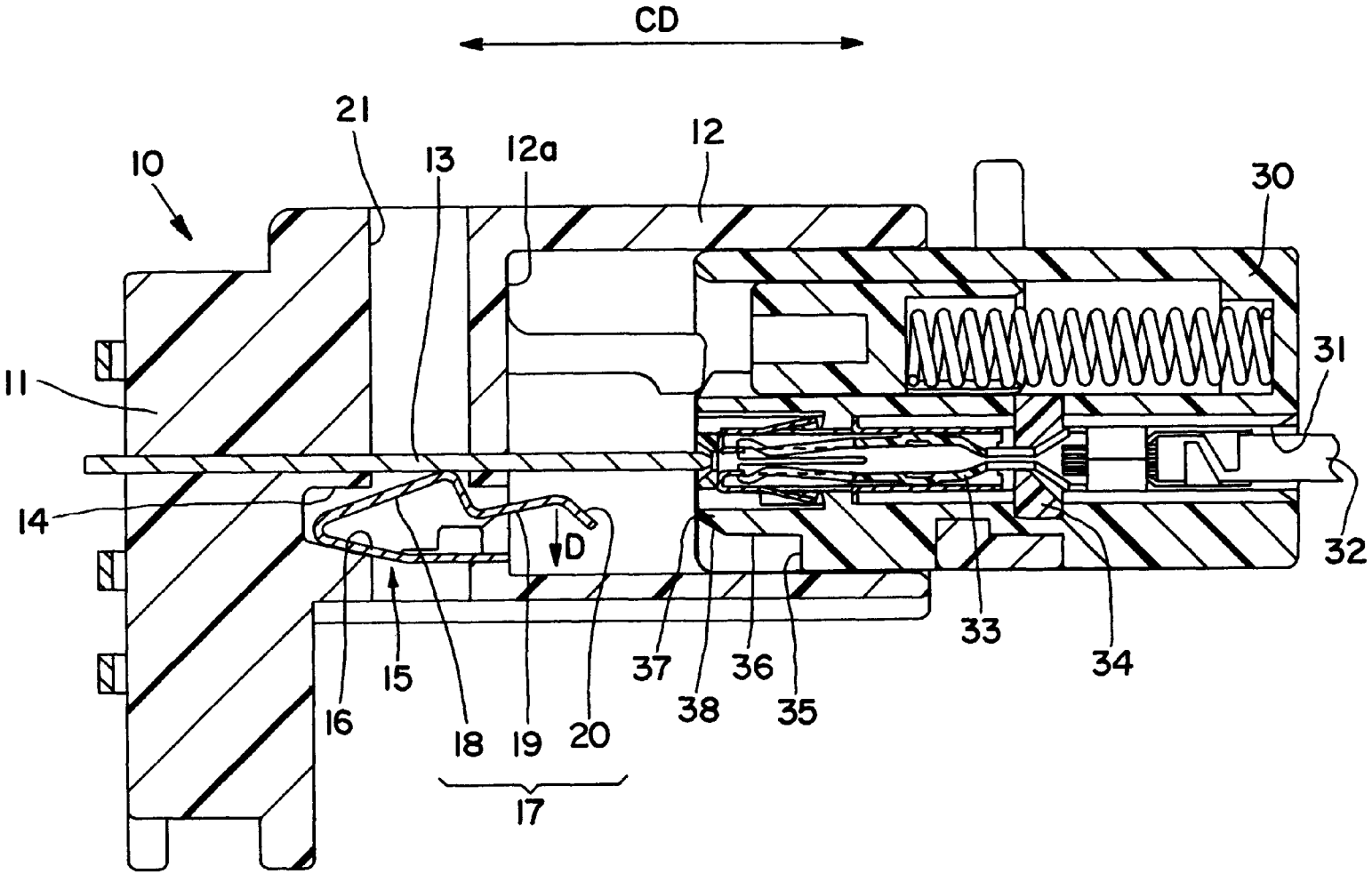
FIG. 1 is a section showing a state at the start of connection of male and female housings according one embodiment of the invention.

A connector in accordance with the invention is comprised of a male housing 10 and a female housing 30, as shown in FIGS. 1 to 6. The housings 10, 30 are at least partly connectable with each other, and sides of the housings 10, 30 that are connected with each other are referred to as the front in the following description.

The male housing 10 is formed e.g., of a synthetic resin and is comprised of a main body 11 and a receptacle 12. The receptacle 12 is a substantially rectangular tube that projects forward from the main body 11. A plurality of male terminal fittings 13 are provided substantially side by side at the substantially same height in the main body 11, and the leading ends of the terminal fittings 13 project into the receptacle 12. The female housing 30 is at least partly fittable into the receptacle 12.

The main body 11 is formed with an accommodation space 14 that is open in the back end wall of the receptacle 12, and a shorting terminal 15 is fixed in the accommodation space 14. The shorting terminal 15 has a substantially plate-shaped main section 16 and e.g., four resilient contact pieces 17 folded or bent from the rear end of the main section 16 to extend forward. The shorting terminal 15 is fixed by holding the main section 16 in close contact with the bottom surface of the accommodation space 14. Each resilient contact piece 17 is comprised of an angled terminal contact 18, an extending portion 19 that extends forward from the front end of the terminal contact 18, and a receiving piece 20 that extends obliquely forward and down at an acute angle to a connecting direction CD of the housings 10, 30 from the front end of the extending portion 19. The receiving pieces 20 are located inside the receptacle 12 and are spaced from the back end surface 12*a* of the receptacle 12.

The main body 11 is formed with exposure spaces 21 for exposing the bottom surfaces of the male terminal fittings 13 to the accommodation space 14, and the terminal contacts 18 of the shorting terminal 15 are positioned to correspond to the exposure spaces 21. The terminal contacts 18 of the shorting terminal 15 are in contact with the bottom surfaces of the male terminal fittings 13 in the exposure spaces 21 when the housings 10, 30 are not connected, and a specified contact pressure is ensured therebetween by a resilient or elastic restoring force of the shorting terminal 15. Thus, the shorting terminal 15 shorts the four male terminal fittings 13. The insertion of the female housing 30 into the male housing 10 deforms the shorting terminal 15 and moves the terminal contacts 18 away from the male terminal fittings 13, as described later, thereby canceling the shorted state of the male terminal fittings 13. A displacing direction D of the terminal contacts 18 is at an acute angle or a right angle to the connecting direction CD of the housings (down in FIGS. 1 to 4).

The female housing 30 is formed e.g., of a synthetic resin into a substantially block shape, and e.g., four cavities 31 are formed substantially side-by-side inside the female housing 30. Female terminal fittings 33 are connected with ends of wires 32 and are inserted into the respective cavities 31 from behind. A retainer 34 locks the female terminal fittings 33 so as not to come out. The respective female terminal fittings 33 are connected with the male terminal fittings 13 by connecting the two housings 10, 30 with each other.

A recess 35 is open at the front bottom surface of the female housing 30 and extends substantially parallel with the connecting direction CD of the housings 10, 30. The recess 35 includes an outwardly facing substantially planar pressing surface 36 aligned substantially parallel to the connecting direction CD. The pressing surface 36 and the inner wall surface of the receptacle 12 define a space S when the female housing 30 is fitted into the receptacle 12. The extending portions 19 and the receiving pieces of the shorting terminal 15 are insertable into the space S. The shorting terminal 15 is in contact with the pressing surface 36 when the housings 10 and 30 are connected to each other to restrict an upward displacement of the shorting terminal 15 toward the male terminal fittings 13.

A pushing portion 37 is formed at the front end of the female housing 30 and is substantially continuous with the front end of the pressing surface 36 of the recess 35. The pushing portion 37 has a slanted surface 38 that extends obliquely at an acute angle (i.e. <90° and >0°) to the connecting direction CD of the housings 10, 30. The slanted surface 38 preferably has substantially the same inclination as the receiving pieces. 20 of the shorting terminal 15. The slanted surface 38 is at a height or position along a direction normal to the connecting direction CD of the housings 10, 30 that corresponds to the four receiving pieces 20 when the shorting terminal 15 is in contact with the male terminal fittings 13.

The terminal contacts 18 of the shorting terminal 15 are in shorting contact with the male terminal fittings 13 when the housings 10, 30 are separated from each other. Accordingly, there is no potential difference between the male terminal fittings 13. Further, the receiving pieces 20 of the shorting terminal 15 are in the receptacle 12 and face oblique to the connecting direction CD of the housings 10, 30 (see FIG. 1).

Figure 2:
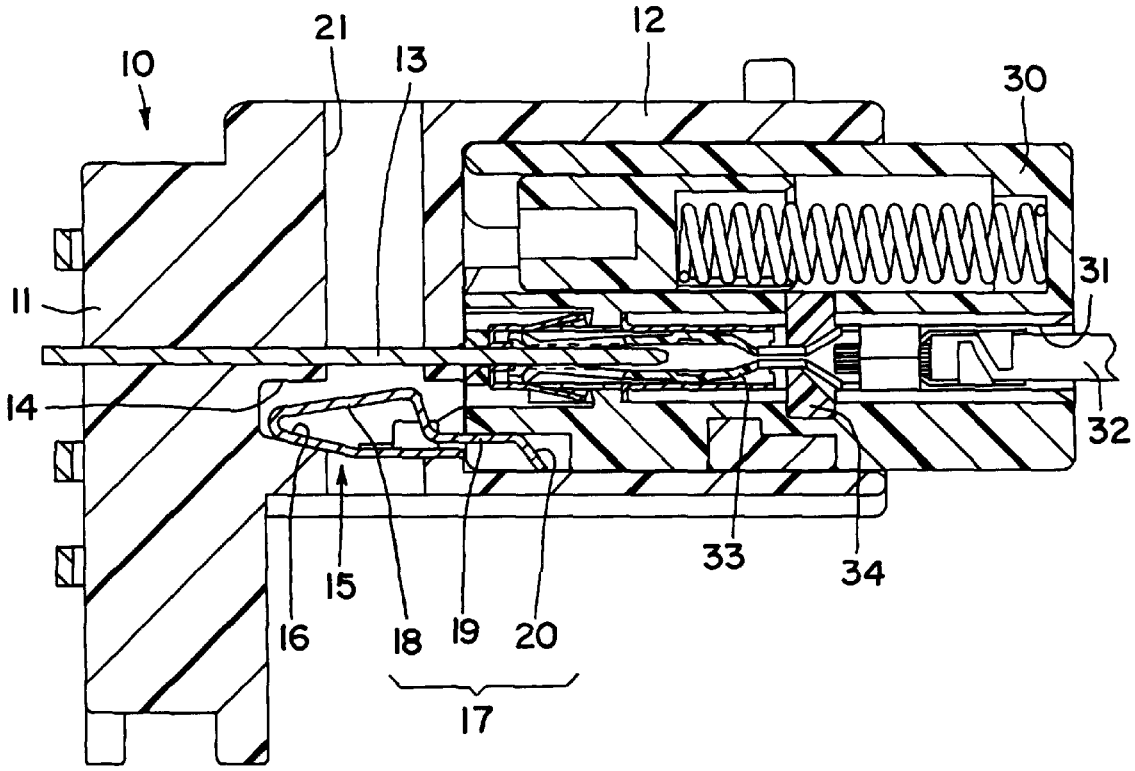
FIG. 2 is a section showing a state where the two housings are connected.
Figure 3:
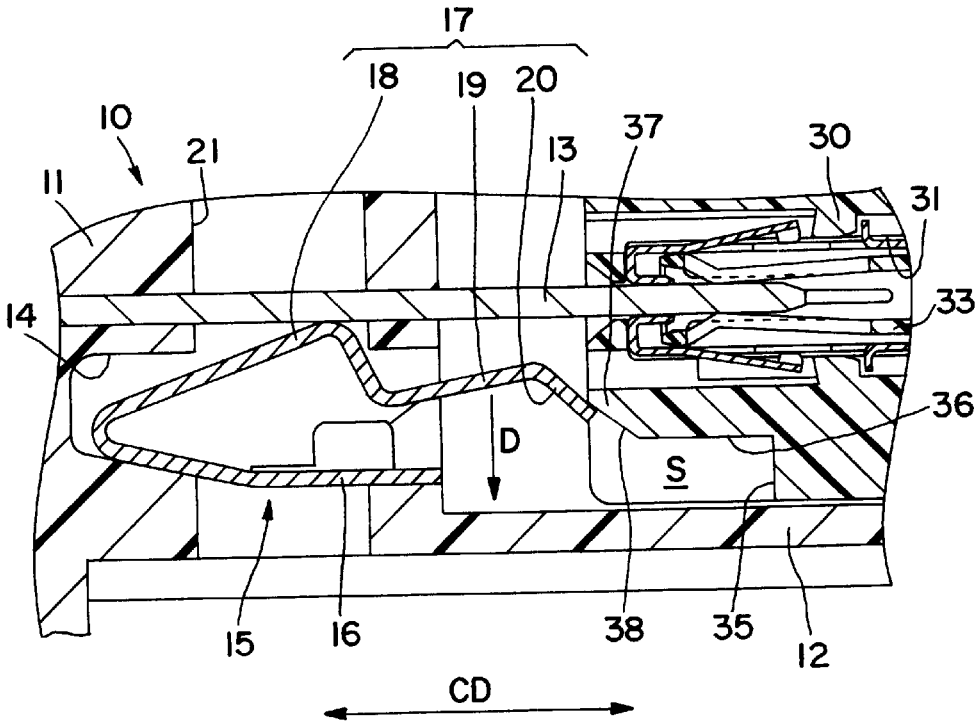
FIG. 3 is a partial enlarged section showing a state where a pushing portion comes into contact with a shorting terminal during connection of the two housings.
Figure 4:
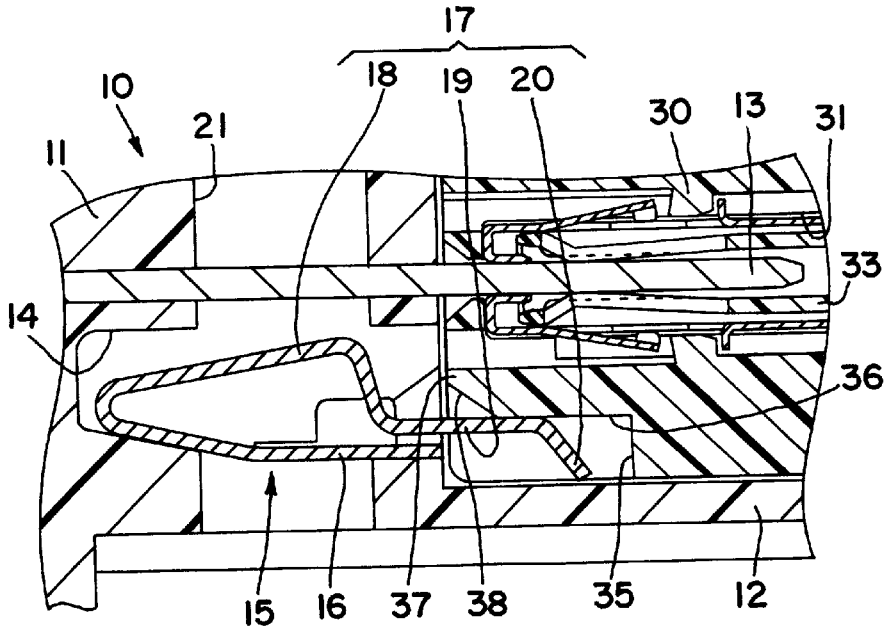
FIG. 4 is a partial enlarged section showing a state where the two housings are connected.
Figure 5:
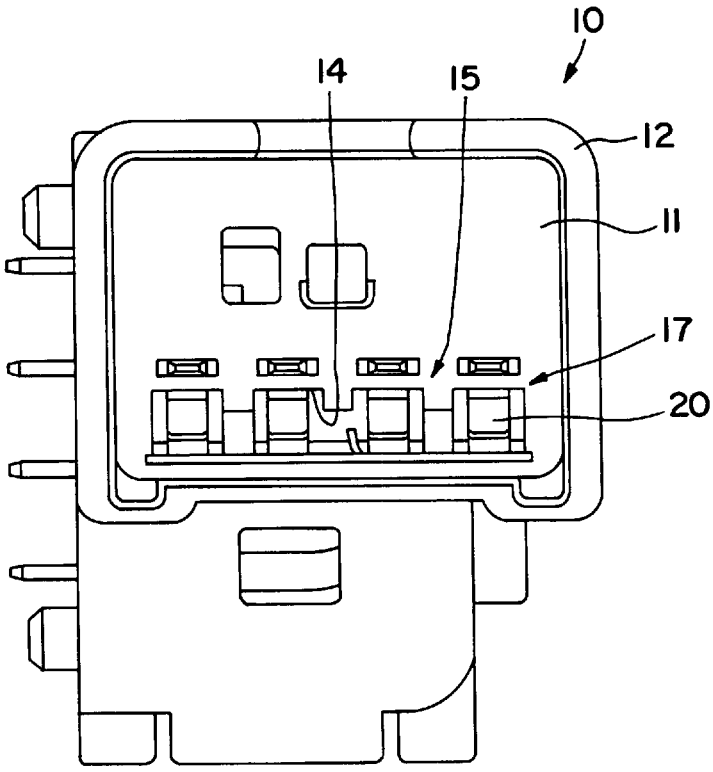
FIG. 5 is a front view of the male housing.
Figure 6:
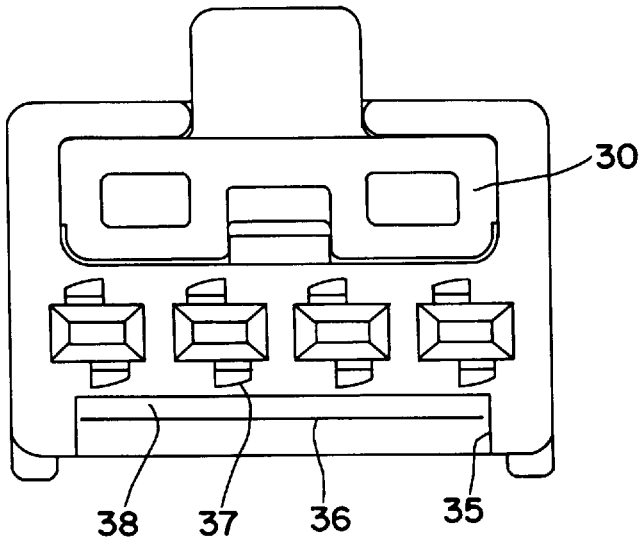
FIG. 6 is a front view of the female housing.

Insertion of the female housing 30 into the receptacle 12 urges the slanted surface 38 of the pushing portion 37 into sliding contact with the inclined receiving pieces 20 as shown in FIG. 3. As a result, the receiving pieces 20 are displaced down in the direction D. The downward displacement of the receiving pieces 20 in the direction D is transmitted to the terminal contacts 18 via the extending portions 19. As a result, the shorting terminal 15 is deformed resiliently to displace the terminal contacts 18 down in direction D substantially normal to the connecting direction CD of the two housings 10, 30. When the housings 10, 30 are connected properly, the terminal contacts 18 are disengaged from the male terminal fittings 13, as shown in FIGS. 2 and 4, thereby canceling the shorted state of the male terminal fittings 13.

The shorting terminal 15 reaches its maximum deformation and the terminal contacts 18 and the receiving pieces 20 are lowest when the receiving pieces 20 disengage from the bottom edge of the slanted surface 38 of the pushing portion 37 and enter the recess 35 formed in the bottom of the female housing 30. Thereafter, the receiving pieces 20 are held at a specified height and are pressed by the pressing surface 36 of the recess 35 from above until connection of the housings 10, 30 is completed. In this state, the extending portions 19 of the shorting terminal 15 are substantially horizontal and in surface contact with the pressing surface 36.

The shorting terminal 15 is restored resiliently or elastically upward during withdrawal of the female housing 30 from the receptacle 12. These resilient restoring forces bring the terminal contacts 18 into contact with the male terminal fittings 13 when the pushing portion 37 is disengaged from the receiving pieces 20.

As described above, the pushing portion 37 is difficult to deform and is provided with the slanted surface 38 for resiliently deforming the shorting terminal 15 in the direction D at an angle and preferably substantially normal to the connecting direction CD of the housings 10, 30. Thus, the pushing portion 37 can securely resiliently deform the shorting terminal 15 away from the male terminal fittings 13 without losing the guiding function of its slanted surface 38 even if the pushing portion 37 and the shorting terminal 15 get caught with each other at their contact portions.

A connector can be constructed such that the shorting terminal is brought into sliding contact with a surface oblique to the connecting direction of the housings. However, the resulting resilient deformation of the shorting terminal would vary in accordance with the depth of connection of the housings. As a result, a spacing between the shorting terminal and the terminal fittings cannot be constant. Contrary to this possible construction, the pressing surface 36 of the subject invention is substantially parallel with the connecting direction of the housings 10, 30 and restricts the approach of the shorting terminal 15 toward the male terminal fittings 13. Accordingly, the degree of resilient deformation of the shorting terminal 15 is constant even if the depth of connection of the two housings varies and, therefore, the air-insulation spacing between the shorting terminal 15 and the terminal fittings 13 is constant.

The slanted surface 38 of the pushing portion 37 and the receiving pieces 20 of the shorting terminal 15 extend obliquely at an acute angle to the connecting direction CD of the two housings 10, 30. These oblique surfaces can slide smoothly over each other without getting caught. Therefore, the shorting terminal 15 can undergo a smooth resilient deformation.

The present invention is not limited to the above described and illustrated embodiment. For example, following embodiments are also embraced by the technical scope of the present invention as defined in the claims. Beside the following embodiments, various changes can be made without departing from the scope and spirit of the present invention as defined in the claims.

The terminal fittings 12 and the shorting terminal 15 are in the male housing 10 and the pushing portion 37 is in the female housing 20 in the foregoing embodiment. However, the terminal fittings and the shorting terminal may be in the female housing and the pushing portion may be in the male housing.

Although the shorting terminal 15 is provided with oblique receiving pieces 20 in the foregoing embodiment, they may be omitted.

Although the pressing surface 36 is formed in the female housing 30 in the foregoing embodiment, it may not be formed and an approach of the shorting terminal 15 toward the terminal fittings 13 may be restricted by bringing the shorting terminal 15 into contact with the slanted surface 38 of the pushing portion 37 with the housings 10, 30 connected with each other.

What is claimed is:

1. A connector, comprising:

a first housing having a front end and a receptacle extending into the front end;

a second housing having a front end insertable into the receptacle by moving the housings along a connecting direction;

a plurality of terminal fittings mounted in the first housing and extending into the receptacle;

a shorting terminal mounted in the first housing and having terminal contacts biased into shorting contact with the terminal fittings, receiving pieces forward of the terminal contacts and disposed in the receptacle, a substantially planar extending portion extending between the terminal contact and the receiving piece;

at least one slanted surface formed at the front of the second housing and aligned oblique to the connecting direction, said slanted surface being disposed for engaging the receiving pieces and resiliently deforming the terminal contacts in a direction away from the terminal fittings during connection of the housings; and a substantially planar pressing surface adjacent to and rearward of the slanted surface, the pressing surface being aligned substantially parallel to the connecting direction and being in surface contact with the extending portion when the housings are connected for maintaining a uniform spacing between the terminal contacts and the terminal fittings as the housings are connected.

2. The connector of claim 1, wherein the receiving pieces and the slanted surface have substantially identical inclinations before the shorting terminal comes into contact with the slanted surface.

3. A connector, comprising:

a first housing having a front end and a receptacle extending into the front end, the first housing further comprising an exposure space rearward of the receptacle;

a second housing having a front end insertable into the receptacle by moving the housings along a connecting direction;

a plurality of terminal fittings mounted in the first housing, the terminal fittings extending through the exposure space; and extending into the receptacle;

a shorting terminal mounted in the first housing and having terminal contacts, the terminal contacts being in the exposure space and being biased into shorting contact with the terminal fittings, the shorting terminal further having receiving pieces forward of the terminal contacts and disposed in the receptacle, the receiving pieces being aligned oblique to the connecting direction;

at least one slanted surface formed at the front of the second housing and aligned oblique to the connecting direction, said slanted surface being disposed for engaging the receiving pieces and resiliently deforming the terminal contacts in a direction away from the terminal fittings during connection of the housings; and a pressing surface adjacent to and rearward of the slanted surface, the pressing surface being aligned substantially parallel to the connecting direction for maintaining a uniform spacing between the terminal contacts and the terminal fittings as the housings are connected.

4. The connector of claim 3, further comprising a rear wall separating the receptacle from the exposure space for preventing contact between the second housing and the terminal contact.

5. A connector, comprising:

a first housing having a front end and a receptacle extending into the front end, the first housing further comprising an exposure space rearward of the receptacle;

a plurality of terminal fittings mounted in the first housing and extending through the exposure space and into the receptacle;

a shorting terminal mounted in the first housing and having terminal contacts in the exposure space and biased into shorting contact with the terminal fittings and receiving pieces forward of the terminal contacts and disposed in the receptacle; and a second housing having a front end and a plurality of side surfaces extending rearwardly from the front end, the front end and portions of the side surfaces adjacent the front end being insertable into the receptacle by moving the housings along a connecting direction, a recess formed at the front end of the second housing and adjacent one said side surface thereof, said recess defining at least one slanted surface adjacent the front end of the second housing and aligned oblique to the connecting direction, said slanted surface being disposed for engaging the receiving pieces and resiliently deforming the terminal contacts in a direction away from the terminal fittings during connection of the housings, and a pressing surface adjacent to and rearward of the slanted surface, the pressing surface being aligned substantially parallel to the connecting direction for maintaining a uniform spacing between the terminal contacts and the terminal fittings as the housings are connected.

6. The connector of claim 5, wherein the receiving pieces and the slanted surface have substantially identical inclinations before the shorting terminal comes into contact with the slanted surface.

7. The connector of claim 6, wherein the shorting terminal comprises an extending portion extending between the terminal contact and the receiving piece, the extending portion being in surface contact with the pressing surface when the housings are connected.

8. The connector of claim 5, further comprising a rear wall separating the receptacle from the exposure space for preventing contact between the second housing and the terminal contact.

* * * * *